United States Patent [19]

Fields

[11] 4,012,865

[45] Mar. 22, 1977

[54] TOY AIRPLANE OF FOLDABLE SHEET MATERIAL AND LAUNCHING MEANS FOR AND METHOD OF MAKING SAME

[76] Inventor: Irvin L. Fields, 708 Center Ave., Holly Hill, Fla. 32017

[22] Filed: Mar. 21, 1975

[21] Appl. No.: 560,688

Related U.S. Application Data

[60] Division of Ser. No. 374,327, June 28, 1973, Pat. No. 3,885,343, which is a continuation-in-part of Ser. No. 277,237, Aug. 2, 1972, Pat. No. 3,768,198.

[52] U.S. Cl. ..... 46/79

[51] Int. Cl.[2] ..... A63H 27/14

[58] Field of Search ..... 46/79

[56] References Cited

UNITED STATES PATENTS

| | | | |
|---|---|---|---|
| 3,768,198 | 10/1973 | Fields | 46/79 |
| 3,885,343 | 5/1975 | Fields | 46/79 |

*Primary Examiner*—G.E. McNeill
*Assistant Examiner*—Robert F. Cutting
*Attorney, Agent, or Firm*—Craig & Antonelli

[57] ABSTRACT

A toy airplane of foldable sheet material which is constructed to glide through the air with a horizontal velocity component after being released in the air above a predetermined starting velocity. A wing and body section of the airplane may be constructed of two separate sheets of foldable sheet material, with one of the sheets forming a substantial part of the body section extending through a slot in the other sheet which forms a substantial portion of the wing section. The sheets forming the wing and body sections are clamped in position with respect to one another by paper staples extending through the sheets. One preferred embodiment of the airplane includes a launching hook securely attached to the sheets forming the wing and body section, which launching hook is also formed of a sheet of foldable sheet material clamped into position by the staples connecting the wing and body sections to one another. Another preferred embodiment includes a holding mechanism including a rubber band or cut-out detents for detachably holding a rocket engine in position under the airplane wing and body section. An improved plastic launching device is provided which includes a relatively rigid portion formed of either folded together and stapled foldable sheet material preferred or a solid plastic bar, each of these rigid members having holes at opposite ends thereof for accommodating endless rubber bands. The method of constructing the airplane includes the cutting out of the various pattern parts from the foldable sheet material, including the cutting of the slot, forming of crease lines along the desired fold lines for the airplane configuration, folding the flat sheets into the desired airplane configuration, and stapling the respective sheets together. The airplane can also be in kit form.

15 Claims, 22 Drawing Figures

FIG. 4
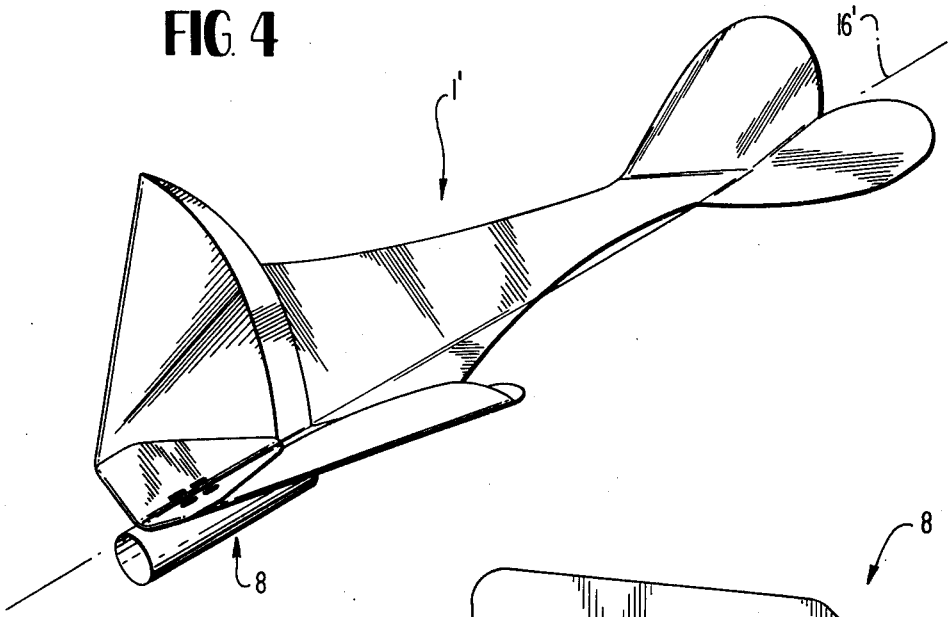
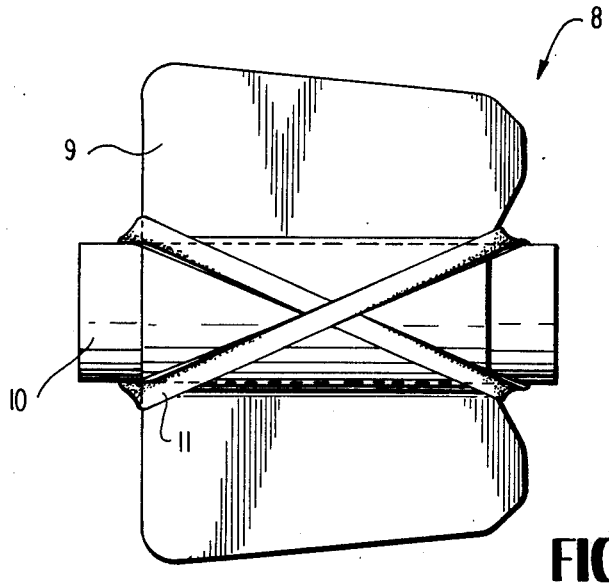
FIG. 5A
FIG. 5B
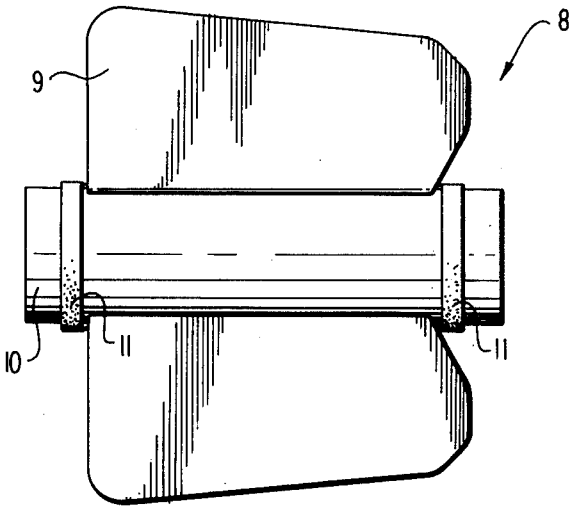
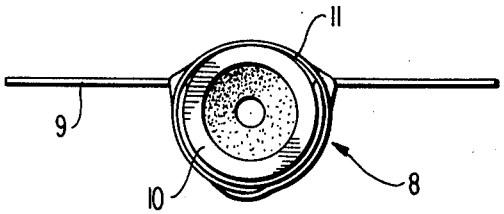
FIG. 5C

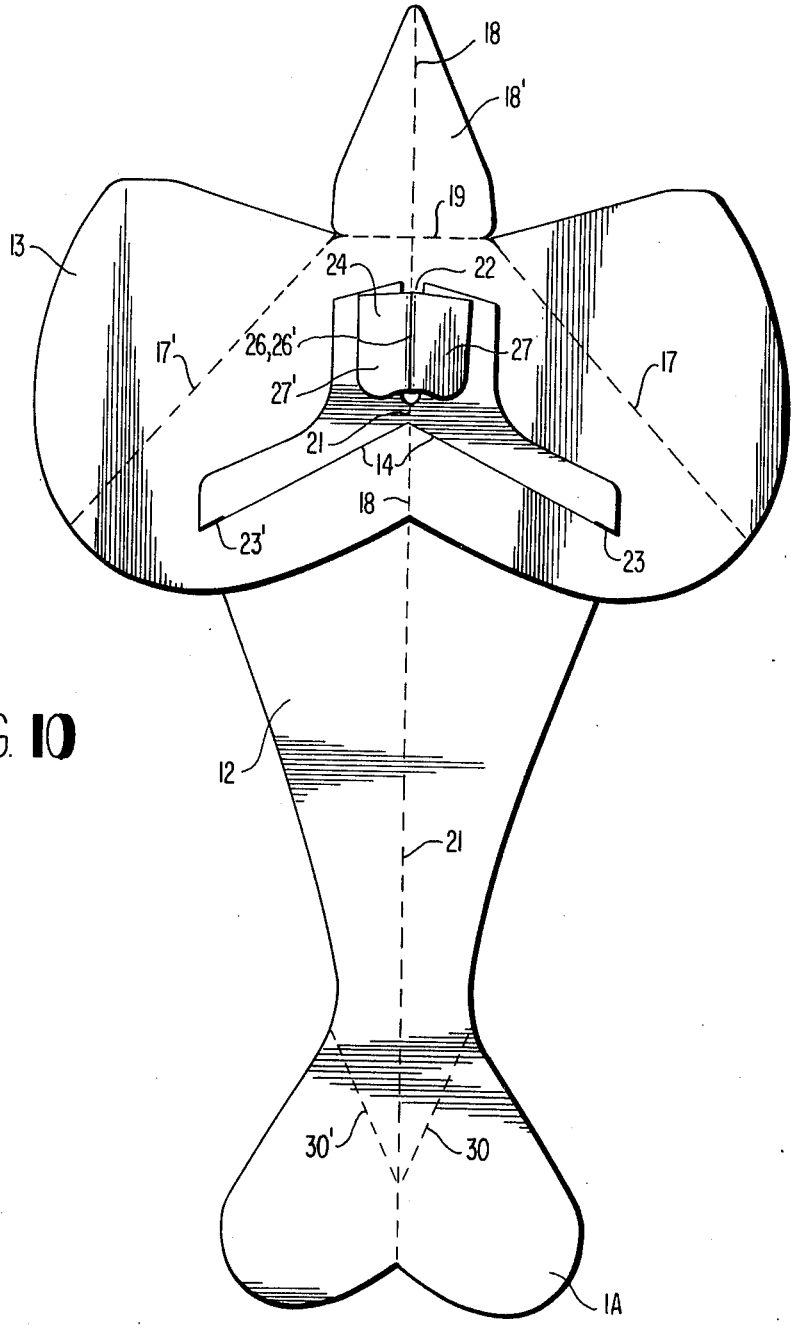
FIG. 10
FIG. 11A
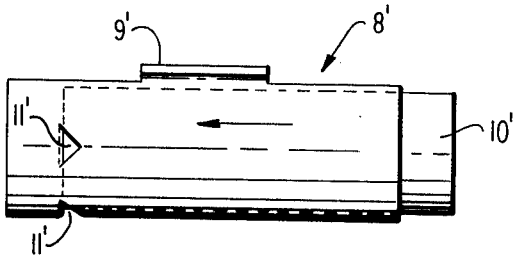
FIG. 11B
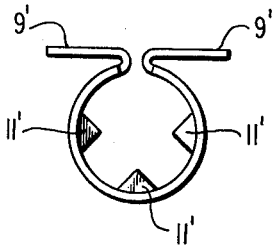

FIG. 12A
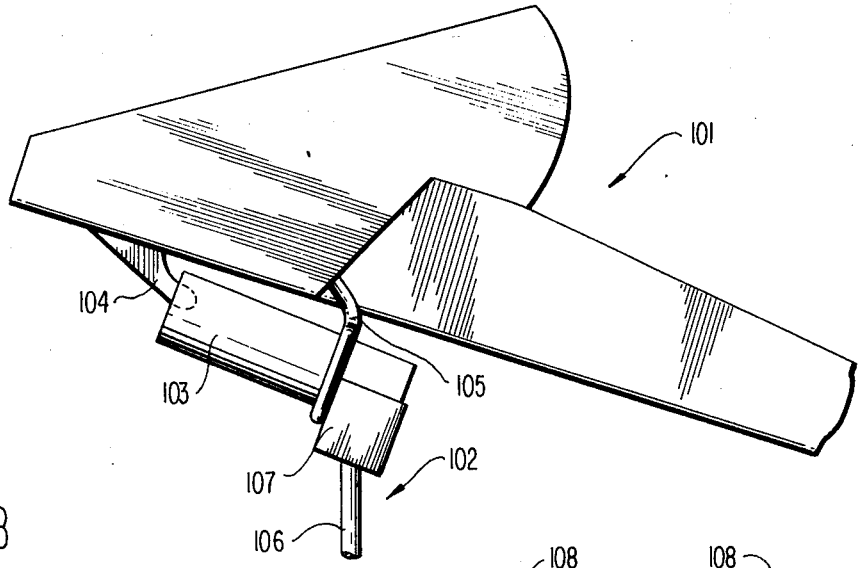
FIG. 12B
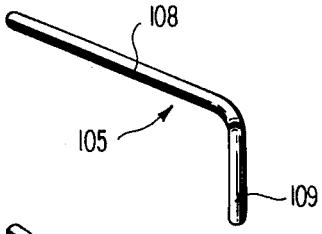
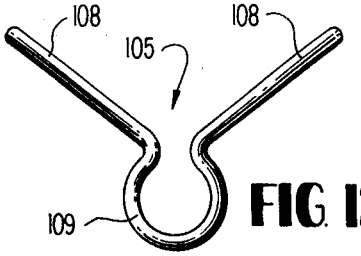
FIG. 12C
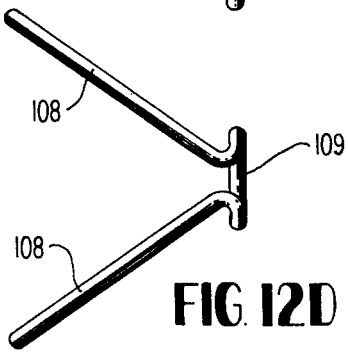
FIG. 12D
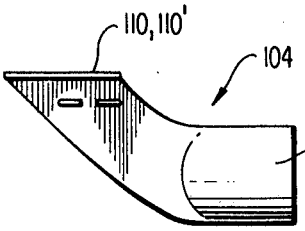
FIG. 12E
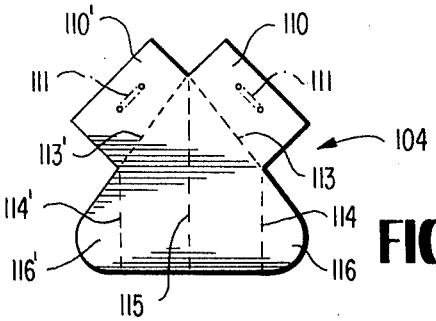
FIG. 12G
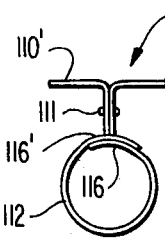
FIG. 12F

TOY AIRPLANE OF FOLDABLE SHEET MATERIAL AND LAUNCHING MEANS FOR AND METHOD OF MAKING SAME

This application is a division of Ser. No. 374,327, filed June 28, 1973, now U.S. Pat. No. 3,885,343, dated May 27, 1976, which in turn is a continuation-in-part of application Ser. No. 277,237, filed Aug. 2, 1972, now U.S. Pat. No. 3,768,198, dated Oct. 30, 1976.

BACKGROUND AND SUMMARY OF THE INVENTION

The present invention relates to improvements in the airplanes, launching mechanisms, and methods of making same disclosed in my above-identified copending application. In the arrangement of this earlier application, a single wire was used to clamp the wing and body sections of the airplane and to form a launching hook. This arrangement substantially reduced manufacturing costs by obviating the need for lamination or direct adhesion of the folded portions of plastic sheet material forming the airplane body and wing sections. The present invention contemplates a modified improved construction of the connection between the wing and body sections which utilizes a slot formed in a sheet of flat plastic material forming the wing section for accommodating a portion of a second sheet which forms a substantial part of the body section of the toy airplane. With this particular slotted sheet construction, the clamping of the sheets together is simplified because the total number of fold lines in the sheets is reduced and because the slot serves to additionally guide and position the wing and body sections with respect to one another.

A further improved feature contemplated by the present invention includes the utilization of simple paper staples for clamping the sheets forming the wing and body sections into the final airplane configuration. With these simple staple connections, one can clamp the sheets together without the necessity of special clamping tools and clamping wires.

The present invention also contemplates an improved launching hook construction which utilizes a further sheet of flat foldable sheet material clamped by the staples to the sheets forming the wing and body sections of the airplane. Since the launching hook utilizes only small amounts of the sheet material, the normally wasted material contained between pattern cutouts for the wing and body sections can be advantageously utilized to form these launching hooks. Also, since the launching hook construction according to the present invention may be formed of the same material as is the wing and body section of the airplane, the total weight of the launching hook with respect to the weight of the total airplane is relatively small as compared to arrangements wherein metal launching hooks are utilized.

The present invention also contemplates improved modifications in the airplane design so as to accommodate rocket engine or fuel cylinder engine propulsion in lieu of the launching hook and rubber band launching arrangement of the above-mentioned earlier application. In this connection, the present invention contemplates the utilization of a flat sheet of material folded into a configuration forming a holder for a rocket engine, with the holder being stapled to the sheets forming the wing and body sections of the airplane. A rubber band may be utilized according to the present invention to clamp the rocket engine into place in the holder formed by the sheet of materials stapled to the airplane wing and body section. With this arrangement of the rocket holder, the total weight of the airplane is minimal and the manufacturing cost for attaching the rocket holder to the airplane construction is minimized. Also, with the simplified rubber band attachment of the rocket engine, the rocket engines may be readily removed and replaced for repeated rocket flights of the same airplane configuration. A modified rocket engine holder includes detents which permit an exhausted rocket to fall away from the airplane.

The present invention also contemplates improvements in launching devices for launching the airplane embodiments having a hook engageable with a resilient means such as a rubber band during the launching operation. Specifically, the present invention contemplates utilization of a relatively flat rigid plastic rod having apertures at opposite ends thereof for accommodating rubber bands. This flat rod configuration presents the advantage that a large printing or labelling surface is obtained for advertising purposes or for written instructions on operation of the device. In a particularly simplified construction of launching device, the plastic rod is formed of a single sheet of flexible flat foldable material which is folded into a rod configuration and stapled by paper staples. This folded and stapled construction facilitates the utilization of similar materials as used for the airplane configuration and thereby reduces total manufacturing costs for the launching devices.

The present invention also contemplates the method of manufacturing the improved airplane and launching mechanism embodiments discussed above, which method includes cutting out the predetermined patterns from the flat sheet material, forming creases in the flat sheet material corresponding to the desired fold lines for the finished airplane configuration, providing the slot in the sheet forming the wing for accommodating the body section, folding the flat material in the final airplane configuration, and clamping the sheets forming the airplane configuration into position by paper staples. It will be understood that the method of construction according to the present invention advantageously reduces the manufacturing costs by ultimately utilizing all of the normally scrap sheet material, by minimizing the number of parts and manufacturing steps and by utilizing only simple readily available manufacturing equipment and supplies.

The present invention also contemplates a build-it-yourself airplane kit and a novel rocket launch stand arrangement.

The above-discussed and other objects, features, and advantages of the present invention will become more apparent from the following description thereof, when taken in connection with the accompanying drawings.

BRIEF DESCRIPTION OF THE DRAWINGS

FIG. 4 is a perspective schematic view showing a toy airplane with a modified rocket propelled launching device constructed in accordance with the present invention;

FIGS. 5A, 5B and 5C are respective bottom, top, and end views of the holder for the rocket cylinder of the FIG. 4 arrangement;

FIG. 10 is a top plan view illustrating the positioning of the pattern sheets for the wing section, the body section, and the launching hook during a stage of the assembly process;

FIG. 11A is a side view of a modified rocket cylinder holder;

FIG. 11B is an end view of the holder of FIG. 11A; and

FIGS. 12A to 12G illustrate various features of a modified airplane and launching arrangement constructed according to the present invention.

DETAILED DESCRIPTION OF THE DRAWINGS

Figure 1:
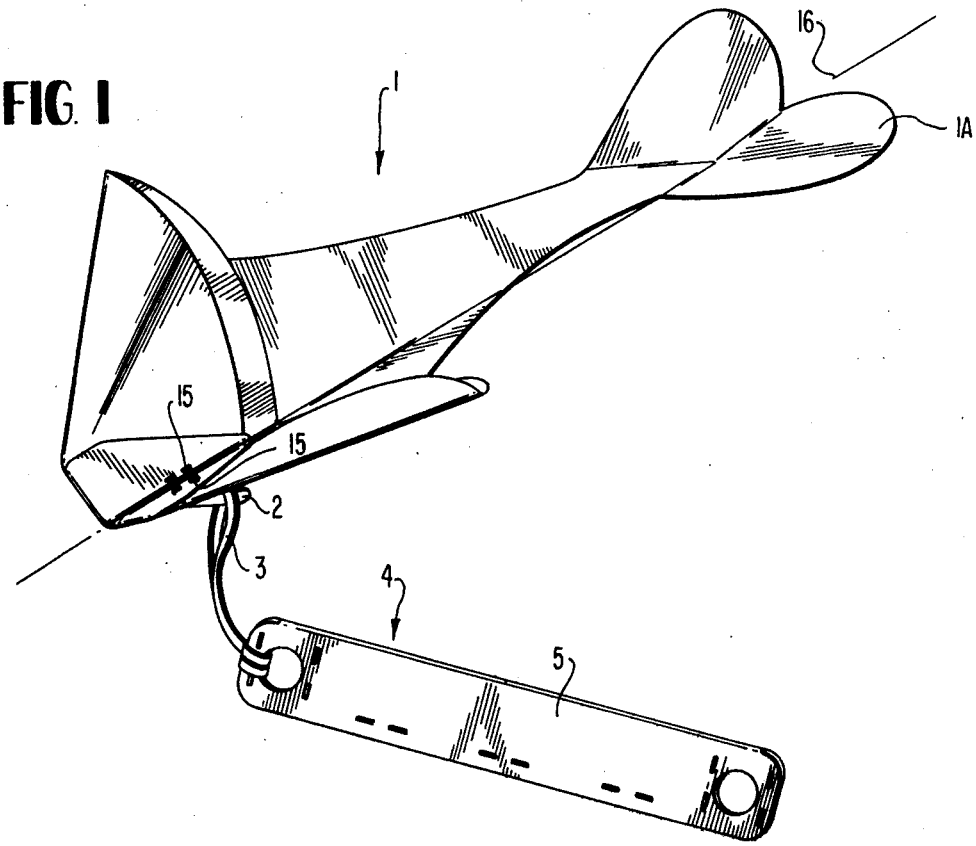
FIG. 1 is a perspective schematic view showing a toy airplane and launching device constructed in accordance with the present invention with the launching device in position for launching the airplane.

Referring now to the drawings, wherein like reference numerals are used throughout the Figures to designate like structure, and more particularly to FIG. 1, there is shown an airplane 1 formed of foldable sheet material and including a launching hook 2, also formed of foldable sheet material. The launching hook 2 is in engagement with rubber band 3 of launching device 4. It will be understood that the launching of the embodiment of the airplane illustrated in FIG. 1 is conducted by holding a rod portion 5 of the launching device in one hand and the tail section 1A of the airplane in the other hand and then pulling the airplane rearwardly with respect to the rod 5 so as to store spring energy in the band 3 until such time as the tail section is released and the spring energy and band 3 accelerates the airplane in the forward direction until such time as the band 3 is released from the launching hook 2.

Figure 2A:
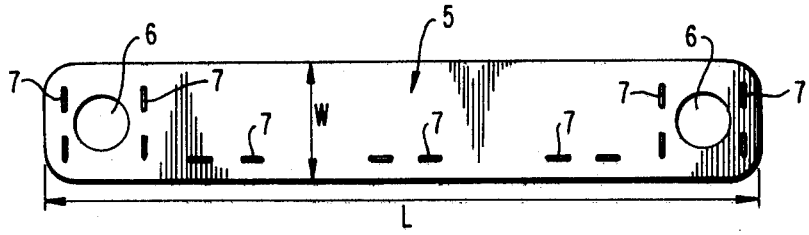
FIGS. 2A and 2B are respective opposite side views of a first embodiment of the rigid part of a launching device constructed in accordance with the present invention.
Figure 2B:
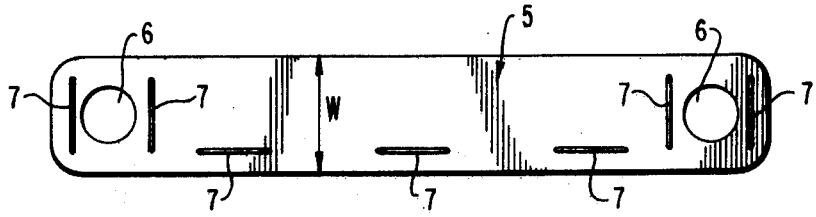

FIGS. 2A and 2B illustrate respective side views of the rod portion 5 of the launching device of FIG. 1. Holes 6 are formed at opposite ends of this rod portion 5 for accommodating the rubber bands 3, it being understood that one would normally include rubber bands attached to both holes 6 of the rod portion 5 so as to have a spare rubber band in the event of a rubber band failure. The rod portion 5 is constructed of a plurality of folds in a single, or possibly in a plurality of, pattern sheets formed of foldable sheet material, which sheet material could be similar to that used in constructing the airplane flight configuration. This sheet material is folded a multiple number of times, with preferred embodiments utilizing six or more folds so as to give sufficient rigidity to the rod portion 5, and then stapled by paper staples 7 (conventional staples used for stapling papers and the like to one another, usually constructed of metallic U-shaped wires which are crimped back upon themselves to clamp the sheets together). As illustrated in FIGS. 2A and 2B, these staples 7 can appropriately be positioned around the holes 6 and along the edge of the rod portion 5 so as to optimize the rigidity of the rod portion and, especially around the holes 6.

Figure 3:
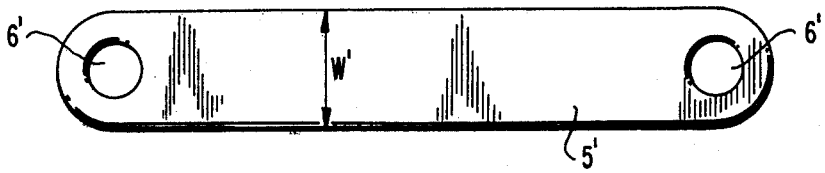
FIG. 3 is a side view showing another preferred embodiment of a rigid part for a launching device constructed in accordance with the present invention.

FIG. 3 illustrates a modified embodiment of launching rod 5′ having holes 6′, which rod 5′ is formed of a solid piece of rigid material, such as plastic. Both of the rod portions exhibit a thickness in a direction perpendicular to the drawing illustration sufficient enough to lend optimum rigidity to the rod portion without unduly increasing the weight thereof. In preferred embodiments, the thickness of the rod portion 5′ is on the order of 1/5 to 1/10 of the width W, W′ of the rod portion. The length L of the rod portion 5 is such as to accommodate a convenient hand hold on the rod portion and to exhibit a sufficient printing area across the length L and width W between the holes 6 for labelling instructions, advertisements, and the like. For example, in preferred embodiments, the length L could be on the order of 4 to 5 inches and the width W on the order of ½ to ¾ of an inch to provide for both a convenient hand-held rod portion and a sufficient space for labelling instructions and the like. The rubber bands 3, as illustrated in FIG. 1, can be conveniently attached and replaced in the holes of the rod portion 6 by merely looping the rubber bands back upon themselves in a conventional manner.

FIG. 4 illustrates a modified toy airplane 1′ which is similar to the airplane of FIG. 1, except that a rocket engine arrangement 8 is substituted for the launching hook 2 and launching device 4 of the FIG. 1 arrangement. As best seen in FIGS. 5A to 5C, this rocket or fuel cylinder propelling arrangement 8 includes a single sheet of foldable sheet material 9 which is bent into a configuration to form a cradle for a fuel cylinder 10 (shown in dash lines). This sheet 9 is attached by stapling to the sheets forming the airplane configuration 1′ by use of paper staples. To facilitate the ready exchange and replacement of fuel cylinders 10, a simple rubber band arrangement 11 holds the fuel cylinder in place on the sheet 9. This rubber band arrangement 11 consists of a single rubber band stretched over end portions of the fuel cylinder 10 to clamp the fuel cylinder in position against the sheet 9. The length in the direction of the fuel cylinder 10 of the sheet 9 is appropriately shorter than the fuel cylinder 10 so as to accommodate the clamping of the rubber band at both ends thereof about the fuel cylinder.

Figure 6:
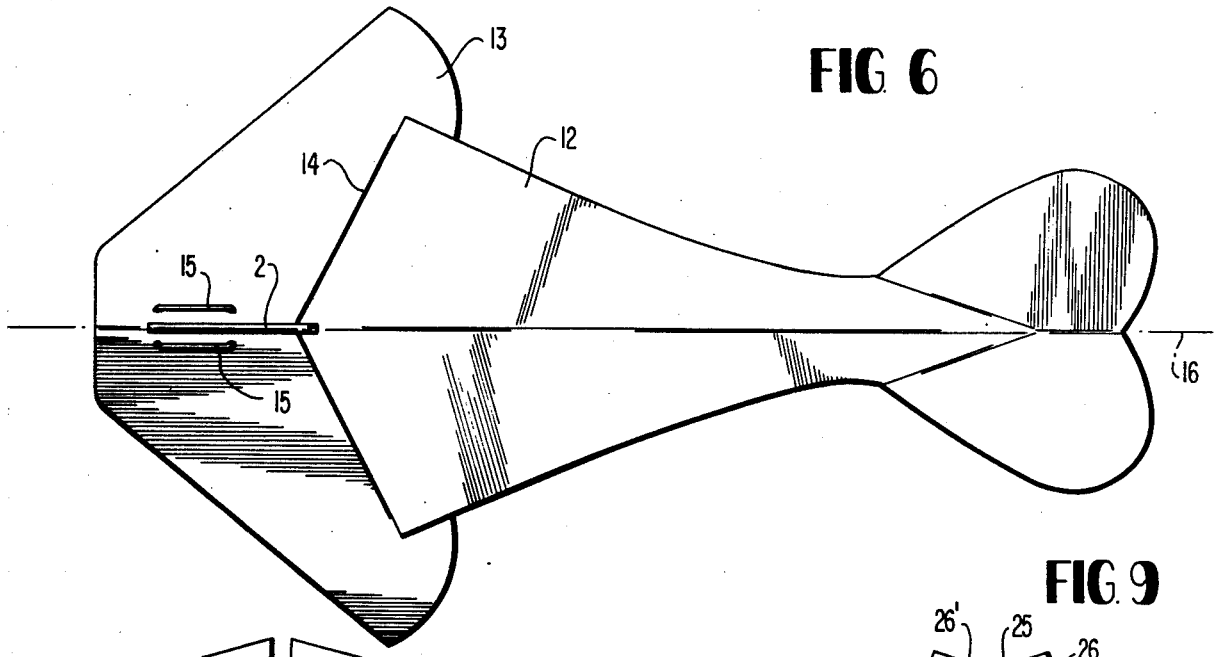
FIG. 6 is a bottom view of the airplane shown in FIG. 1.

FIG. 6 is a bottom view of the airplane of FIG. 1 which illustrates the interconnection of the sheet 12 forming the airplane body section and the sheet 13 forming the airplane wing section by way of the extension of sheet 12 through slot 14 in the sheet 13. The sheets 12 and 13 are clamped together in the final airplane configuration by way of staples 15, which also clamp the sheet forming the launching hook 2 in position, as will be best understood from the following description with respect to FIGS. 9 and 10. The airplane configuration is substantially symmetrical with respect to longitudinal airplane centerline 16 (16′ in FIG. 4).

Figure 7:
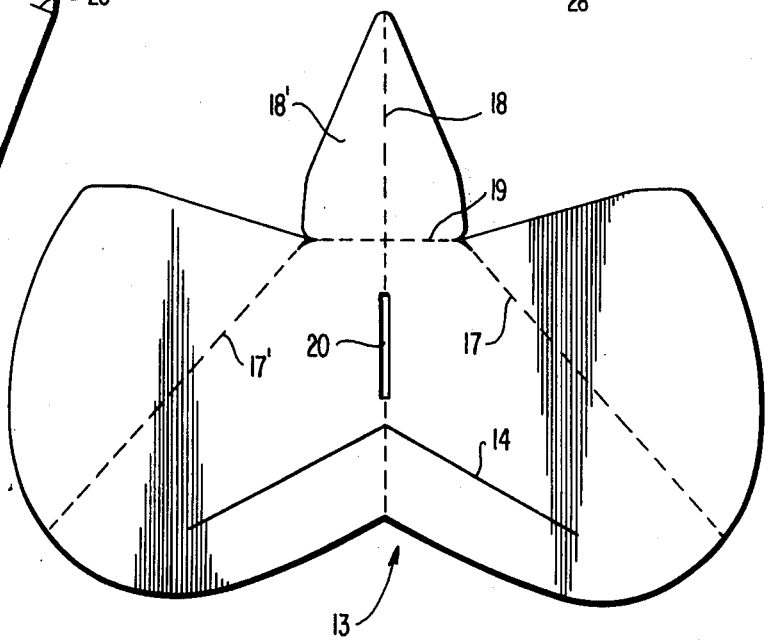
FIG. 7 is a plan view showing the crease lines, holes, and slots in a pattern sheet forming the wing section of the airplane of FIG. 1 prior to assembly.

FIG. 7 illustrates the pattern sheet 13 for the wing configuration in a flattened condition prior to assembly. Crease lines 17 and 17′ are symmetrically arranged at opposite sides of the centerline crease line 18, and crease line 19 extends transverse thereto. An aperture 20 is provided between crease line 19 and slot 14 for accommodating protrusion of the launching hook 2 in the assembled condition.

Figure 8:
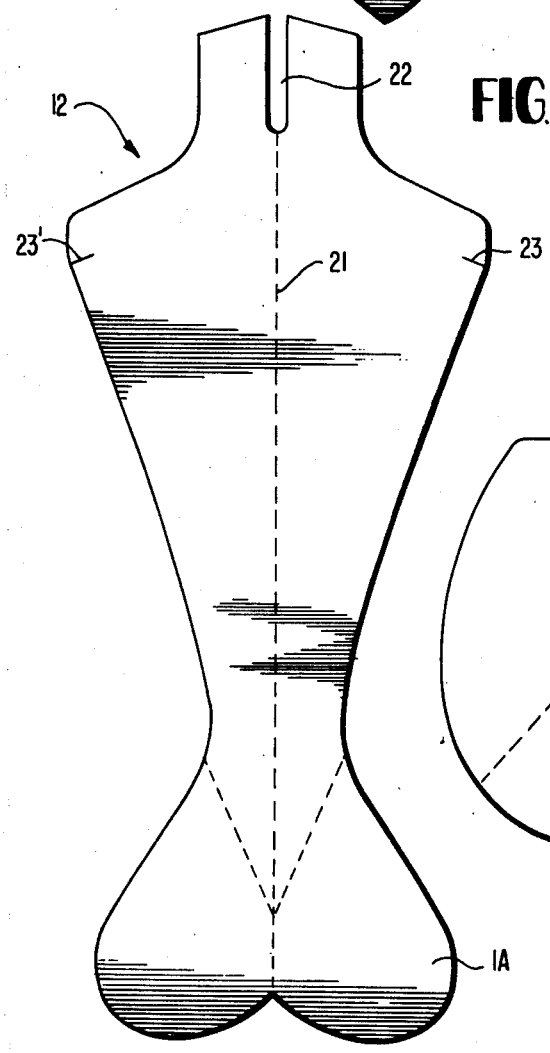
FIG. 8 is a plan view of a pattern sheet for the body section of the airplane prior to assembly.

FIG. 8 illustrates pattern sheet 12 in a flattened condition prior to assembly, with longitudinally extending crease line 21 extending from the tail section 1A to the forward end of the sheet 12. A wide slot or aperture 22 is provided for permitting protrusion of the launching hook 2 in the assembled condition. Short cuts or slots 23 and 23′ are provided for interengaging with the sheet 13 adjacent the respective outer ends of the slot 14 in the assembled condition.

Figure 9:
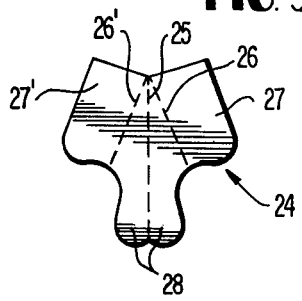
FIG. 9 is a plan view showing the pattern sheet for the launching hook prior to assembly.

FIG. 9 illustrates a flattened pattern sheet 24 for forming the launching hook 2. This sheet 24 includes a central longitudinal crease line 25 and lateral crease lines 26 and 26′. In the assembled condition, the crease lines 25, as well as the crease lines 26 and 26′ will all be in alignment with the longitudinal airplane centerline 16, with crease line 25 extending below the wing and body section of the airplane and the crease lines 26 and 26′ extending along a single line substantially in alignment (spaced by the thickness of the sheet of material 24) with the crease line 21 of the body section. The flat sections 27 and 27′ laterally outwardly of the respective crease lines 26 and 26′ lie flattened against the respective adjacent portions of the pattern sheets 12 and 13 for the body and wing sections in the assembled condition.

FIG. 10 schematically illustrates the positioning of the respective pattern sheets 12, 13 and 24 in the final assembly of the airplane. The pattern sheet 12 is extended forwardly through slot 14 of the wing section pattern sheet 13 with respective centerfold crease lines in alignment with one another. The pattern sheet 24 is then folded along crease line 25 and the hook portions 28 thereof are protruded downwardly through the respective aligned slot 22 and aperture 20, while the side portions 27, 27′ are folded along crease lines 26 and 26′ so as to lie in engagement with the upperwardly facing portion of the sheet 12 adjacent the slot 22. The sheet 13 is then folded along lines 17 and 18, with nose portion 18′, as seen in FIG. 10, folded upwardly out of the plane of the drawing and back upon the flat portions of the sheet 24, the sheet 12, and the sheet 13. The portions of the wing section pattern sheet 13 laterally outwardly of the respective crease lines 17 and 17′ are likewise folded upwardly out of the plane of the drawing back toward the centerline. Once these portions are folded into position, staples 15 clamp the same into the final airplane configuration illustrated in FIG. 1. It is further noted that in the assembled condition, the slots 23 and 23′ provide for the interengagement of the most lateral portions of the sheet 12 with the lateral outermost portions of slots 14 so as to prevent rearward withdrawal of the sheet 12.

With the above-described interconnection of the wing and body sections of the airplane, the number of manufacturing steps are minimized due to the slotted wing arrangement which facilitates connection of the wing and body sections with a minimum of folding lines on both the body and wing section pattern sheets.

Although the above-description has specifically referred to the airplane configuration illustrated in FIG. 1 in describing the connection of the wing and body section pattern sheets, it will be understood that the embodiment of FIG. 4 could be constructed in a similar manner, except that the pattern sheet 24 for the launching hook would be eliminated, as well as the slot 22 and hole 20 for accommodating the launching hook. The launching mechanism 8 would then be simply attached underneath the assembled configuration by way of staples extending through the sheet 9 and one or more of the respective folds of the pattern sheets 12 and 13.

The particular contour configuration of the wing and body section of the airplane may be chosen so as to optimize the desired slight characteristics, while also taking into account packaging requirements, etc. Also, the relative longitudinal extent of the body section with respect to the width of the wing section can be varied to give different gliding characteristics. During launching of the toy airplane according to the present invention, one can effectively vary the "pitch" of the airplane by the way one folds the tail section. That is, by varying the angle between the tail section sides and the longitudinal centerline 16, 16′ of the airplane, one can obtain different looping flight characteristics. By selecting appropriate sheet material having the capability of retaining a position for a certain period of time after being bent, one can further enhance the control of the flight characteristics. In preferred embodiments of the present invention, the sheet material used for pattern sheets 12, 13 and 24, as well as for forming the rigid rod portion 5, was similar to that utilized and described in connection with my above-identified copending application. Also, the relative thickness of the wing and tail sections can be varied in accordance with the present invention to optimize the flight characteristics. In this connection, the differences in weight and relative positioning with respect to the center of gravity, of the launching hook to, and/or the fuel cylinder 8 would affect the particular sheet material selected.

It is further noted that the present invention also contemplates the construction of an airplane utilizing both a launching hook and a fuel cylinder propellant arrangement, with the same being appropriately spaced on the airplane to accommodate simultaneous utilization of same. For example, the launching device and launching hook 2 could be utilized to assist in imparting initial acceleration to the airplane, with the fuel cylinder adding inflight additional propulsion.

Reference numerals 30 and 30′ (FIG. 10) refer to optional crease lines that may be included to further optimize the adjustment of the airplane flight characteristics.

FIGS. 11A and 11B illustrate a modified rocket holder 8′ formed of a single piece of flat material folded into a cylindrical rocket accommodating section and having projections 9 which are to be stapled into position on the airplane in much the same manner as in the FIG. 5 embodiment. A plurality of intersecting pairs of linear cut-outs 11′ are provided around the circumference of the cylindrical portion and the sheet material adjacent thereto bent inwardly (see FIG. 11A) to form rocket engaging detents. These detents engage a forward portion of rocket cylinder 10′ to transmit forward (large arrow in FIG. 11A) thrust forces from rocket cylinder 10′ to an airplane carrying holder 8′. Once the rocket is expended, it can fall rearwardly out of the holder in response to its own weight, whereby the airplane can sail more freely without the rocket. It is further contemplated to provide a simple stand to hold the airplane in a vertical position for rocket launch operations. Such a stand (FIG. 12A) includes two plastic rods ⅛ inch in diameter and of sufficient length to be pushed into the earth and still protrude upwardly to vertically support the airplane for launching at a desired launch angle.

The present invention further contemplates making the airplane arrangements described above in non-assembled kit form with instructions for the assembly thereof. Such a kit includes a box or package approximately two inches deep, 8 inches wide and 24 inches long containing the flattened and pre-creased and pre-marked sheets for forming the various airplane and launch apparatus. The launching hooks, rocket stand, fuel cylinders, etc. could also be included in the kit package. The total size of the kit package will, of course, depend on the size, type and number of airplane configurations included therein, the above dimensions being exemplary of a preferred embodiment. Since a single paper stapling machine is all that is needed to assemble the airplane from the flat sheets, the airplane readily lends itself to such a do-it-yourself kit. The following described embodiments can also be furnished in a kit form.

FIGS. 12A to 12G show still further embodiments of the invention with FIG. 12A being a perspective view showing airplane 101 in position on launch stand 102 for launch by way of ignitable rocket cylinder 103. Since airplane 101 can be constructed similar to airplane 1 of FIG. 1, further details thereof, other than as they relate to operation of the rocket launching and propelling arrangement, are not included in this description.

The rocket cylinder 103 is maintained in propelling position on airplane 101 by forward reacting member 104, which is fashioned as an aluminum or plastic flat sheet stapled to the airplane and protruding rearwardly to engage inside of the front of cylinder 103, and clamp 105 which holds the rear of the fuel cylinder 103 away from the airplane so as to prevent burning of the rear portion of the plane by the hot exhaust gases of the rocket cylinder 103. Clamp 105 is loosely inserted between flat sheet portions of the airplane and aids in giving rigidity and stability to the airplane configuration during rocket launching and propelling operations. Since clamp 105 is only loosely inserted at the airplane, clamp 105, as well as the rocket cylinder 103, falls freely from the airplane after the rocket fuel is burned up and no further rocket propelling forces are applied against fuel cylinder 103 to hold it in abutting engagement with reacting member 104.

Launch stand 102 includes two telescopingly adjustable legs 106 which are inserted into a wood block 107. Block 107 includes an upwardly facing part-cylindrical cradle for cradling a portion of the airplane and rocket cylinder arrangement, preferably by engaging directly at the underside of the rocket cylinder 103 as shown. Block 107 includes small holes for accommodating insertion and attachment of the legs 106 by riveting, friction fitting, screwing, or the like. These holes may extend partially or completely through the wood block, but preferably extend completely through to accommodate simple manufacture thereof. The legs may be of steel or plastic construction and preferably include cylindrical, concentric, telescoping members. Block 107 may alternatively be constructed of plastic or metals.

FIGS. 12B, 12C and 12D are respective side, end, and top views of the clamp 105, which is constructed of a single piece of rod-like material bent to form a rocket cylinder cradle portion 109 and two leg portions 108. In use, leg portions are inserted loosely between the flat sheets forming the wing and tail sections at a position through the underside of the slot in the wing section (see FIG. 1). The sheets of the airplane are sufficiently clamped together in this area to maintain the clamp 105 in position when the assemblage of FIG. 12A is at rest and when rocket cylinder 103 is propelling the airplane. However, upon burning of all of the fuel of the cylinder 103, the air flow past the cylinder and clamp, as well as the weight thereof, permits or causes the cylinder 103, as well as the clamp 105, to fall to the ground so that the airplane can continue in a free flight condition without the added weight and air resistance of the cylinder and clamp.

FIGS. 12E and 12F are respective side and end views of the forward reacting member 104, which is constructed of a single piece of flat plastic sheet material folded and stapled together (see FIG. 12G for a showing of the flat sheet preliminary to folding into the in-use configuration). Member 104 includes portions 110 and 110' which in use are inserted upwardly through a slot at the underside of the wing and are stapled by staples (staple holes 111 schematically depicted in FIG. 12G) in much the same manner as described above for the attachment of the launching hook of FIG. 9. Clamp 104 further includes rocket engaging portion 112 which is configured so as to be insertable into the forward end of cylinder 103. Alternatively, clamp 104 could be configured to surround the circumference of the front end of the cylinder 103 and to include a forward abutment to engage the front of the cylinder. FIG. 12G shows the flattened pattern sheet for clamp 104 with crease lines 113, 113', 114, 114', and 115. Crease line 115 is aligned with the longitudinal centerline of the airplane in the assembled condition, crease lines 113, 113' accommodate insertion and clamping to the airplane flat sheets, and crease lines 114, 114' accomodate formation of the portion 112 with overlapping parts 116, 116'. In FIG. 12F, 111 indicates the position of a third staple for holding member 104 in the in-use configuration.

In further preferred non-illustrated embodiments, the member 104 could be constructed of foldable aluminum flat sheets, or a unitary extruded plastic piece, also clampable to the airplane by paper staples.

Also, the member 104 may be advantageously configured to serve as both a propelling hook for rubber band propulsion and a forward reacting member for alternative rocket propulsion of the airplane.

Small relief holes (not illustrated) can be provided in member 104 to prevent rocket reactive forces from tearing member 104 from the plane.

While I have shown and described several embodiments in accordance with the present invention, it is to be understood that the same is not limited thereto but is susceptible to numerous changes and modifications as known to a person skilled in the art, and I, therefore, intend to cover all such changes and modifications as are within the scope of those skilled in the art. In this connection, it is noted that the novel launching hook and rocket launch accommodating mechanisms of the present invention could be utilized with airplanes constructed in accordance with my earlier application, including single sheet embodiments.

I claim:

1. A toy airplane comprising: a plurality of sheets of normally flat sheet material folded into an airplane configuration having a body section and a wing section, both of said body section and said wing section being substantially symmetrically disposed with respect to a longitudinal airplane axis, said body section and wing section being constructed so as to fly through the air upon being released in the air above a predetermined starting velocity, wherein a first of said sheets includes a slot through which a portion of a second of said sheets protrudes in the assembled condition of the airplane.

2. A toy airplane according to claim 1, wherein said first sheet forms substantially the entire wing section and said second sheet forms substantially the entire body section.

3. A toy airplane according to claim 2, wherein said sheets are formed of synthetic resinous material.

4. A toy airplane according to claim 2, wherein said sheets making up the airplane configuration are folded along the airplane longitudinal axis so as to present a V-shaped configuration.

5. A toy airplane according to claim 1, further comprising clamping means for holding said wing section in position with respect to said body section, wherein said clamping means includes fastener means protruding through portions of said first and second sheets to clamp said first and second sheets together.

6. A toy airplane according to claim 5, wherein said first sheet forms substantially the entire wing section and said second sheet forms substantially the entire body section.

7. A toy airplane according to claim 6, wherein said fastener means includes at least one paper staple.

8. Launching means for a toy airplane comprising a relatively rigid part and a relatively resilient part, said resilient part being directly and abuttingly engageable with a hook means on a toy airplane, wherein said relatively rigid part is formed with at least one hole for accepting said relatively resilient part.

9. Launching means according to claim 8, wherein said relatively rigid part is formed of a single sheet of normally flat flexible sheet material folded into a rigid rod-like part.

10. Launching means according to claim 9, wherein said single sheet is formed of synthetic resinous material, and wherein the folds of said rigid rod-like part are fastened together by paper staples.

11. Launching means according to claim 8, wherein said relatively rigid part includes an outwardly facing labelling surface for accommodating written launching instructions and the like.

12. Launching means according to claim 11, wherein said relatively rigid part is formed from a solid flat rod of rigid plastic material, and wherein holes for said resilient means are formed at both ends of said rod.

13. A method of making a toy airplane comprising: cutting out at least one airplane pattern sheet for an airplane wing and body sections from a flat sheet of material, cutting out a launch accomodating means pattern sheet from a flat sheet of material, forming fold lines in said at least one airplane pattern sheet and in said launch accommodating pattern sheet corresponding to the predetermined final desired fold configuration for the airplane wing and body sections and for the launch accommodating means, folding said pattern sheets into the final configuration for the airplane, and clamping said pattern sheets together in said final configuration.

14. A method according to claim 13, wherein said launch accommodating means is a propelling hook extending downward from the wing and body sections of the airplane, said pattern sheet forming said hook being fastened by staples to said at least one pattern sheet forming said wing and body sections.

15. A method according to claim 13, wherein said launch accommodating means is a holder for a rocket fuel cylinder, said pattern sheet forming said holder being fastened by staples to said at least one pattern sheet forming said wing and body sections.

* * * * *